United States Patent [19]

Nelle et al.

[11] Patent Number: 4,884,759

[45] Date of Patent: Dec. 5, 1989

[54] WINDING APPARATUS

[75] Inventors: Friedrich Nelle, Stuttgart; Heinz Lehner, Obserschneiding; Klaus Nitzsche, Straubing, all of Fed. Rep. of Germany

[73] Assignee: Nokia Graetz, Pforzheim, Fed. Rep. of Germany

[21] Appl. No.: 331,005

[22] Filed: Mar. 28, 1989

Related U.S. Application Data

[63] Continuation of Ser. No. 109,074, Oct. 16, 1987, abandoned.

[30] Foreign Application Priority Data

Oct. 16, 1986 [DE] Fed. Rep. of Germany ..... 3635220

[51] Int. Cl.[4] ..... B21F 3/10; H01F 7/20; H01F 41/04

[52] U.S. Cl. ..... 242/7.14; 29/605; 140/92.2

[58] Field of Search ..... 242/7.03, 7.06, 7.07, 242/7.14, 7.15, 7.16; 140/92.1, 92.2; 29/605, 606

[56] References Cited

U.S. PATENT DOCUMENTS

| | | | |
|---|---|---|---|
| 3,995,785 | 12/1976 | Arick et al. | 242/1.1 R |
| 4,217,937 | 8/1980 | Ache et al. | 242/7.13 X |
| 4,256,268 | 3/1981 | Fahrbach | 242/7.11 |
| 4,417,698 | 11/1983 | Pernet et al. | 242/7.14 X |
| 4,469,285 | 9/1984 | Farbach | 242/7.14 |
| 4,547,238 | 10/1985 | Lenders | 242/7.03 X |

FOREIGN PATENT DOCUMENTS

| | | | |
|---|---|---|---|
| 46453 | 4/1980 | Japan | 242/7.14 |
| 23451 | 2/1982 | Japan . | |

*Primary Examiner*—Joseph J. Hail, III

*Attorney, Agent, or Firm*—Peter C. Van Der Sluys

[57] ABSTRACT

A winding apparatus, for winding saddle coils for deflection units of picture tubes, has a wire guide tube that is movable along the contour of the desired windings in three mutually perpendicular planes. A receiving device for the coil form is rotatable about its longitudinal axis. In another embodiment the coil form remains stationary and the wire guide tube has one end angled at 90° and rotatable about its longitudinal axis.

4 Claims, 3 Drawing Sheets a)

b)

c)

d)

WINDING APPARATUS

This is a continuation of copending application Ser. No. 109,074 filed on Oct. 16, 1987 now abandoned.

BACKGROUND OF THE INVENTION

1. Field of the Invention

The present invention relates to an apparatus for winding saddle coils and more particularly to such an apparatus having a wire guide tube.

2. Description of the Prior Art

Saddle coils are used in deflection units on cathode-ray tubes for horizontal deflection of the electron beam. They frequently consist of individually series-connected strands which lie in grooves of a coil form. They may also consist of windings which are placed in a form provided with suitably shaped receiving portions and are later baked to form a self-supporting saddle coil. If the planes of the strands do not pass through the center of the coil form, the Winding process can no longer be performed with conventional winding apparatus from a given inclination of the strands.

SUMMARY OF THE INVENTION

An object of the present invention is to provide a winding apparatus with which saddle coils of any shape can be wound quickly.

The present invention contemplates a winding apparatus having a wire guide tube for winding saddle coils. The wire guide tube is movable in three mutually perpendicular planes along the contour of the turns to be wound. A device for receiving the coil form is rotatable about its longitudinal axis.

In a particular embodiment the wire guide tube has one end angled at about 90° and is rotatable about its longitudinal axis. In this embodiment rotation of the coil form is no longer necessary.

DESCRIPTION OF THE PREFERRED EMBODIMENT

Figure 1:
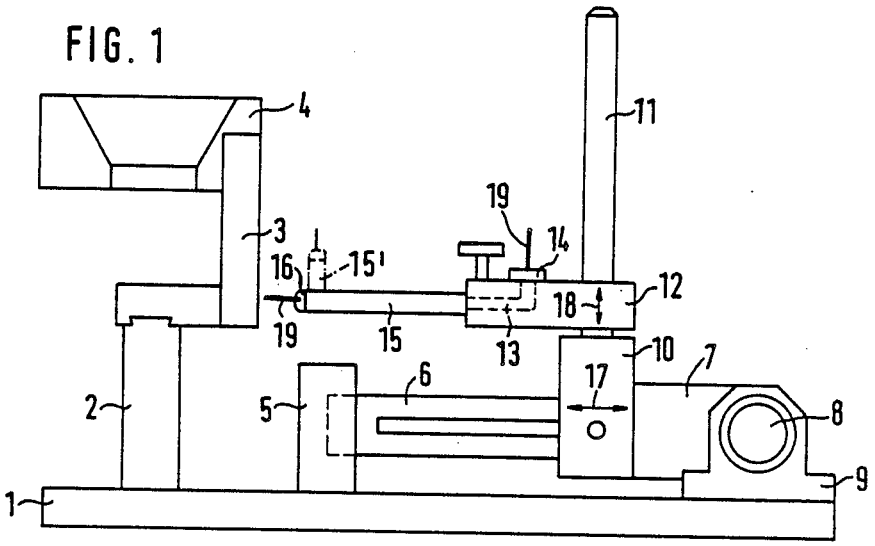
FIG. 1 is a schematic side view of an apparatus for winding saddle coils.
Figure 2:
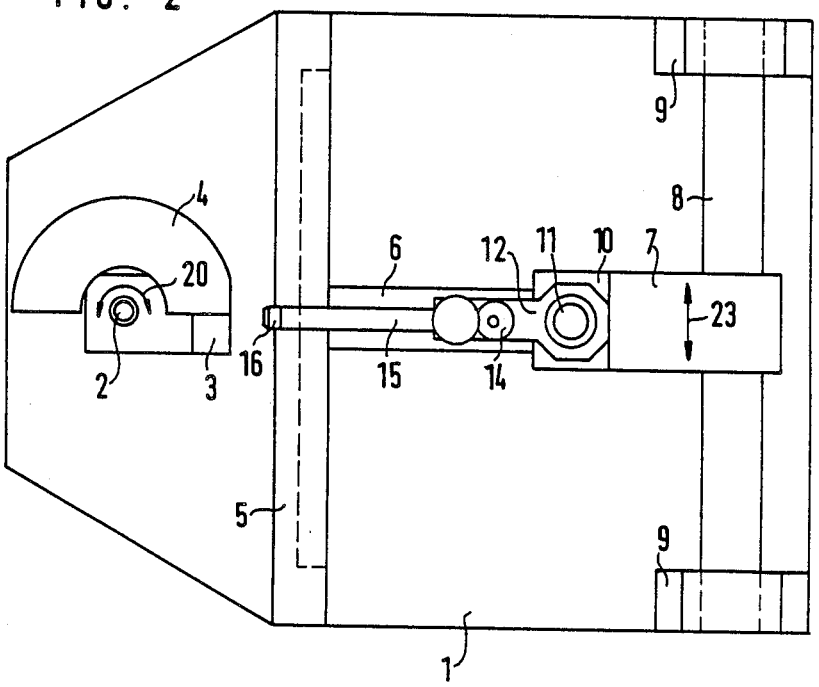
FIG. 2 is a top view of the apparatus of FIG. 1.

Referring to FIGS. 1 and 2 a base plate 1 supports a pillar 2 whose upper end bears a supporting arm 3 having a receiving device 4 for a coil form (not shown) attached thereto. Beside this, the base plate 1 supports a mechanism which can be moved in three mutually perpendicular planes. This mechanism includes a support 5 for a horizontal bar 6, whose other end is mounted in a slide 7. The slide 7 can slide on another horizontal bar 8, which is disposed at right angles to the bar 6. The bar 8 is connected with the base plate 1 via two supports 9. A mount 10 capable of sliding along the bar 6 holds a vertical bar 11 on which a holding device 12 can slide. For the wire 19, the holding device 12 has a channel (indicated by broken lines) 13 with an inlet member 14 at one end and a horizontal wire guide tube 15 at the other. The free end of the wire guide tube 15 has an outlet member 16 attached thereto. The inlet and outlet members correspond to devices commonly used for such purposes.

The supporting arm 3 with the receiving device 4 can rotate about the longitudinal axis of the pillar 2. The slide 7 and, thus, the bar 6 can move along the bar 8, i.e., perpendicular to the plane of the paper in FIG. 1. The mount 10 is movable along the bar 6 in the direction of the double-headed arrow 17. The holding device 12 can be moved along the bar 11 in the direction of the double-headed arrow 18. The three motions are mutually at right angles, so that the outlet member 16 can be moved to any point in the space defined by the planes of motion.

Driving devices necessary for these motions are not shown in the schematic representation for the sake of clarity. For the same reason, only short pieces of wire are shown at the inlet member 14 and the outlet member 16, and no wire reel is shown.

FIG. 2 clearly shows the possible motion of the slide 7 along the bar 8; this motion is indicated by the double-headed arrow 23. It is also apparent that the support 5 extends over the entire width of the base plate 1 and has a receiving portion for the end of the bar 6 in the area opposite the bar 8. The movement of the holding arm 3 with the receiving device 4 about the longitudinal axis of the pillar 2 is indicated by the curved doubleheaded arrow 20.

The winding process will now be described with the aid of FIGS. 3 to 6, in which only a coil form 21 with its grooves 22 for receiving the wire 19 is shown to illustrate the process more clearly.

Figure 3:
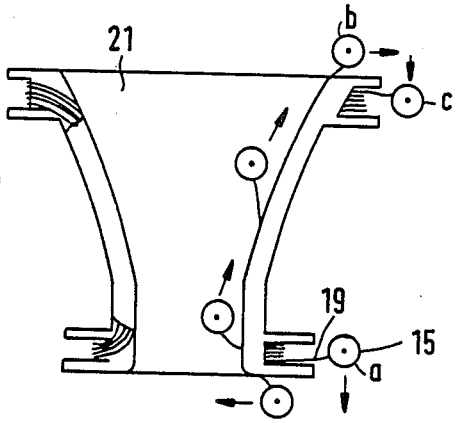
FIG. 3 shows the path of a wire guide tube along a groove in a coil form.

FIG. 3 shows the coil form 21 in a side view and the path of the wire guide tube 15. From its initial position a, the wire guide tube 15 moves downwards, then along the lower rim of the coil form 21, and subsequently upwards to a position in front of the groove into which the wire is to be placed, the motion being indicated in the figure by arrows. The wire guide tube then moves upwards and to the right until it reaches the position b above the upper rim of the coil form. From there, it moves to the right and then downwards to the position c corresponding to the position shown in FIG. 4*a*.

FIG. 4*a* shows the coil form 21 in a top view and the wire guide tube 15 in position c. The coil form 21 is now rotated clockwise (arrow 24) by 180°, with the wire 19 being placed into a groove, shown clearly in FIG. 3, running parallel to the upper rim. At the end of this operation, the position shown in FIG. 4*c* is reached.

FIG. 4*b* shows the coil form 21 with a rim partly cut away to reveal the wires lying in the groove therebelow. This figure also shows that the planes of the grooves 22 and, thus, the planes of the desired strands of the saddle coil do not pass through the center 26 of the coil form 21.

Figure 4:
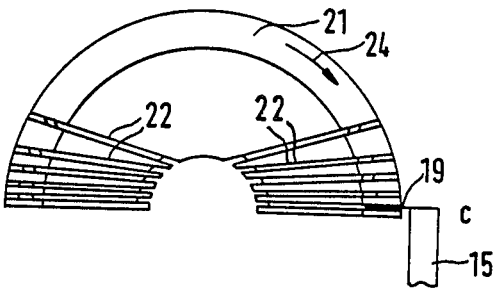
FIGS. 4*a* to 4*d* show the rotation of the coil form for winding an upper winding head.
Figure 4:
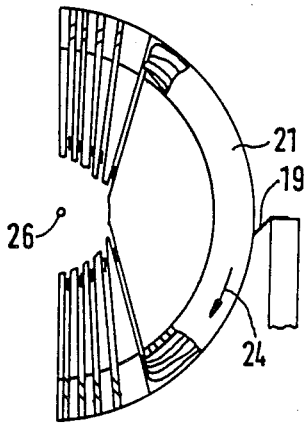
Figure 4:
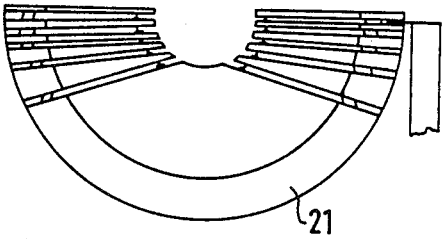
Figure 4:
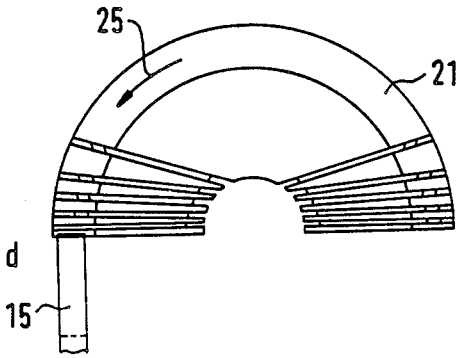

The wire guide tube then moves upwards, i.e., out of the plane of the paper as shown in FIG. 4, and the coil form 21 is rotated counterclockwise (arrow 25) by 180°. At the same time, the wire guide tube moves to the left until it reaches the position d shown in FIG. 4*d*.

Figure 5:
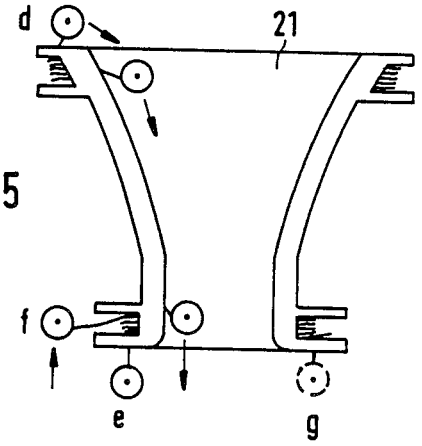
FIG. 5 shows the path of the wire guide tube along another groove.

In FIG. 5, the position d of the wire guide tube and the coil-form position of FIG. 4*d* are shown in a side view. The wire guide tube now moves downwards until it reaches the position e. From there, it moves to the left and then upwards until it reaches the position f to the side of the groove running parallel to the lower rim of the coil form. In this position, the coil form 21 is rotated counterclockwise by 180°, with the wire 19 being laid into the groove. The wire guide tube then moves back to the position designated e, and the coil form is rotated back clockwise by 180°, with the wire guide tube moving to the right until it reaches the position g (indicated by a broken line). This position is approximately equal to the initial position, and the next turn is wound in similar fashion. When the first groove 21 has been filled, the wire guide tube moves from its initial position to a position in front of the next groove and performs the winding process as described above.

If use is made of a wire guide tube 15, with an angled end as indicated by broken lines in FIG. 1, the need to rotate the coil form 21 during the winding process is eliminated. The winding of saddle coils with an angled wire guide tube will be described in the following.

Figure 6:
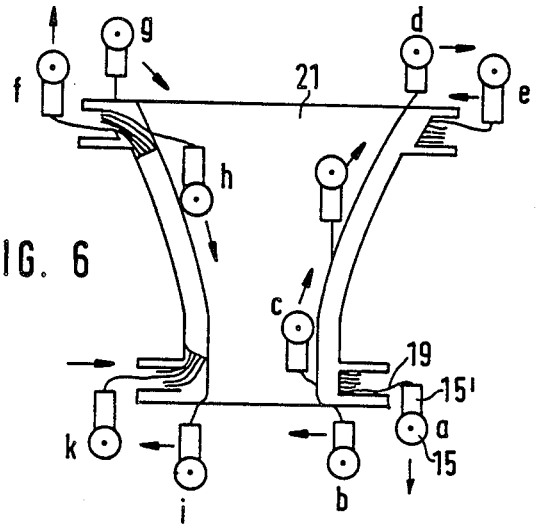
FIG. 6 shows the path of an angled wire guide tube during the winding of the saddle coil.

FIG. 6 shows the path of the angled wire guide tube during the winding of the saddle coil. The wire guide tube is in its initial position a, the angled end pointing upwards. It moves via position b to position c. On the way from position b to position c, the wire guide tube rotates clockwise about its longitudinal axis by 180°, so that the angled end points downwards. After reaching position e via position d, the wire guide tube moves to the left to position f, with the coil form 21 remaining in the position shown in FIG. 6. On the way from position f via position g to position h, the wire guide tube rotates clockwise about its longitudinal axis by 180°, so that its angled end points upward in position h. Via position i, the wire guide tube moves to position k. From there, it moves to the right and returns to position a, i.e., its initial position. Thereafter, the next turn is wound as described above.

What is claimed is:

1. An apparatus for winding saddle coils on a coil form having a central axis and preformed grooves in which said coil is to be wound, said grooves being formed in both interior and exterior surfaces of said coil form, a portion of said grooves not lying in planes passing through the central axis, said apparatus comprising:

a device for supporting the coil form;

means for rotating said device about the central axis of the coil form;

a wire guide tube having a wire outlet; and means for linearly moving said guide tube in three directions orthogonal to each other, one of said directions being parallel to the central axis of the coil form, and for operating in co-operation with the means for rotating said device so that the wire outlet moves along paths defined by said grooves, whereby any point in a space defined by the maximum linear movement of the wire outlet of the guide tube can be reached by the wire outlet, and the wire outlet is positionable adjacent to the coil form and movable along the contour of turns to be wound in the grooves of the coil form.

2. An apparatus as described in claim 1, wherein a portion of said grooves lie in planes perpendicular to the central axis.

3. An apparatus for winding saddle coils having top and bottom coil portions and first and second side coil portions on a coil form having inside and outside surfaces formed partially about a central axis and preformed grooves in which said coil is to be wound, said grooves comprising an upper groove on the outside surface of the form for receiving the top coil portion, a lower groove on the outside surface of the form for receiving the bottom coil portion, and a plurality of grooves on the inside surface of the form on first and second sides of the form for receiving the first and second coil portions, a portion of the grooves receiving the first and second coil portions lie in planes not passing through the central axis, said apparatus comprising:

a device for supporting the coil form;

means for rotating said device about the central axis of the coil form;

a wire guide tube having a wire outlet; and means for linearly moving said guide tube in three directions orthogonal to each other, one of said directions being parallel to the central axis of the coil form and for operating in co-operation with the means for rotating said device, so that when winding the coil from an inside groove at one of said first and second sides of the saddle coil to a corresponding inside groove on the other of said first and second sides of the saddle coil, the wire guide tube is first kept in a fixed position, the device is rotated by an amount equal to the angular distance between said corresponding inside grooves, thereby winding the coil into a respective outside groove to a position adjacent the corresponding inside groove on the other side of the coil, after which the device is rotated in the opposite direction by the same angular distance while the wire guide tube is moved together with the form in such a way that it does not change its position relative to the inside groove on the other side, after which the guide tube is moved along the inside groove on the other side and the process is repeated to form windings of the saddle coil.

4. An apparatus for winding saddle coils having top and bottom coil portions and first and second side coil portions on a coil form having top and bottom rims, first and second sides, inside and outside surfaces formed partially about a central axis, and preformed grooves in which said coil is to be wound, said grooves comprising an upper groove on the outside surface of the form disposed adjacent the top rim for receiving the top coil portion, a lower groove on the outside surface of the form adjacent the bottom rim for receiving the bottom coil portion, and a plurality of grooves on the inside surface of the form disposed adjacent said first and second sides of the form for receiving the first and second side coil portions, a portion of the grooves formed on the inside surface lying in planes not passing through the central axis, said apparatus comprising:

a device for supporting the coil form;

means for rotating said device about the central axis of the coil form;

a wire guide tube having a wire outlet; and means for linearly moving said guide tube in three directions orthogonal to each other, one of said directions being parallel to the central axis of the coil form and for operating in co-operation with the means for rotating said device when winding the coil so that, starting with the inside surface of the form facing the guide tube and the guide tube disposed adjacent the lower groove of the form and one of said plurality of side grooves, the guide tube is moved downwardly to below the bottom rim then towards the central axis and upwardly along one of said side grooves to a point above the top rim, then outwardly away from the central axis and downwardly to a position adjacent the upper groove, after which the form is rotated in a first rotation direction so that the upper groove moves past the guide tube to a point adjacent a corresponding side groove on the other side of said form, after which the guide tube is moved upwardly above the top rim and the form is rotated in a second direction opposite the first direction, while simultaneously the guide tube is moved together with the form to maintain the same relative position with the form, the guide tube is then moved inwardly towards the central axis then downwardly along the inside surface and one of said side grooves to a point below the bottom rim, then outwardly away from the central axis and upwardly to a position adjacent the lower groove, after which the form is rotated in the second rotation direction so that the lower groove passes the guide tube into a position where the guide tube is adjacent a side groove on the opposite side of the form, after which the guide tube is moved downwardly below the bottom rim and the form is rotated in the first angular direction while the guide tube is moved simultaneously with the form to maintain the same relative position, whereby one complete coil turn is wound.

* * * * *